United States Patent [19]

Pollock et al.

[11] 3,943,330

[45] Mar. 9, 1976

[54] METHOD AND APPARATUS FOR ELECTRICALLY HEATING A FLUID

[75] Inventors: James Francis Pollock, Henley; Peter Douglas Dunn, Moulsford; Graham Rice, Reading; Basil Dixon Power, Crawley, all of England

[73] Assignee: United Kingdom Atomic Energy Authority, London, England

[22] Filed: Feb. 25, 1974

[21] Appl. No.: 445,421

[30] Foreign Application Priority Data

Feb. 26, 1973 United Kingdom ..... 9441/73

[52] U.S. Cl. ..... 219/381; 219/275; 219/307; 219/374; 219/553; 417/152; 417/208

[51] Int. Cl.[2] ..... H05B 3/14; F24H 1/10

[58] Field of Search ..... 219/296–309, 219/374–376, 381, 382, 552, 553, 271–276; 222/146 HE, 146 R; 417/152, 208

[56] References Cited

UNITED STATES PATENTS

| | | | |
|---|---|---|---|
| 3,688,083 | 8/1972 | Rice et al. | 219/381 |
| 3,781,518 | 12/1973 | Power et al. | 219/381 UX |

*Primary Examiner*—A. Bartis

*Attorney, Agent, or Firm*—Larson, Taylor & Hinds

[57] ABSTRACT

Fluid heating arrangements and methods are provided wherein liquid is caused to flow through a fluid permeable electrical resistance heater body. Prior to the heater body, the liquid passes through a fluid permeable flow control member which offers a uniform resistance to the entire flow of the liquid. Static pressure head of the fluid varies over the entry surface of the flow control member, and the permeability of the combination of the heater body and the flow control member are such as to cause a pressure drop in the fluid greater than the variations in static pressure head of the fluid at the entry surface of the flow control member. This promotes a uniform flow of the fluid through the heater body even in the presence of significant differences in static pressure head over the fluid entry surface of the flow control member. The permeability of the flow control member may be such that the pressure drop across the flow control member alone is greater than the variation in the static pressure head of the fluid over the entry surface of the flow control member.

22 Claims, 2 Drawing Figures

METHOD AND APPARATUS FOR ELECTRICALLY HEATING A FLUID

The invention relates to devices for heating fluids and particularly for heating liquids including heating to evaporate the liquid and heating to superheat the vapour formed by evaporation of the liquid.

Devices comprising a heater body of permeable electrically conductive material through which fluid is passed and in which heat is generated by passage of an electric current through the heater body are attractive in principle because the large surface area of contact between fluid and heater body allows the heat generated to be transferred to the fluid in an effective and advantageous manner. Such devices have been proposed for heating fluids for a variety of purposes and have proved suitable for heating gases, and liquids such as water to a temperature below the saturation temperature or boiling point of the liquid.

Difficulties are however often encountered in practice with such devices, especially when the heater body material is of low resistivity and the fluid is a liquid which is to be heated close to the saturation temperature, or to the saturation temperature and above. For example, there can be problems in heating the fluid in a uniform and controlled manner so as to achieve precise control over fluid temperature or fluid quality and to avoid a wide variation in temperature and quality of the fluid over the exit surface of the heater body. For example, it has been found that boiling or evaporation of the fluid occurs outside the heater body due to the high temperature of the entry surface of the heater body under some conditions of operation. A further problem of such devices is that in some cases the temperature of the permeable heater body is very non-uniform and therefore localised regions of very high temperature exist within the heater body. In these regions the fluid may be severely over-heated such that unwanted thermal decomposition or degradation of the fluid occurs. If the decomposition products are solids these products may be deposited on the internal and external surfaces of the heater body and lead to partial or complete blockage of the flow passages and consequent accentuation of the operating difficulties.

To a considerable degree such difficulties originate in the nature of the permeable heater body and the fluid characteristics and their influence in determining local heat generation, heat transfer and fluid flow conditions within the permeable heater body. Other significant influences are the fluid hydrostatic and hydrodynamic conditions at entry to the permeable body and the manner in which the permeable body is engineered within the device and in relation to other permeable bodies forming part of the heat transfer and fluid flow system.

Some of these problems are discussed in British patent specification No. 1,182,421. In particular that Specification discloses that surface boiling can be inhibited by providing a layer of permeable electrically insulating material such as alumina on the entry surface of the electrically conducting permeable heater body, and that in operation the alumina becomes heated by conduction from the heater body and the fluid is preheated during its passage through the alumina layer. Furthermore when heating a liquid the amount of conducted heat received by the alumina may be such that the liquid is heated and evaporated in the alumina and the electrically conductive body acts as a superheater for the vapour. The alumina layer may comprise a close fitting alumina tube or the alumina may be applied as a coating to the electrically conductive body.

In specification No. 1,182,421 it was envisaged that the alumina layer may be used with advantage for providing a convenient method of locally modifying the flow so as to obtain substantially uniform diffusion through the electrically conductive body in the presence of non-uniform hydrostatic pressure head over the entry surface of the alumina layer. To achieve this British patent specification No. 1,182,421 suggests that the porosity of the alumina sleeve may be varied according to the height of the element (i.e. by using a number of short sleeves of varying porosity to encase the resistor element) to compensate for the pressure head caused by the element height.

However, with a fuller knowledge of the problems of operating the heater disclosed in Specification No. 1,182,421 it can be shown that varying the porosity of the alumina sleeve along its length has an effect on the pattern of heat flow from the electrically conducting permeable heater body through the porous alumina layer. Due to this effect the temperature distribution over the entry surface of the porous alumina sleeve may be non-uniform and especially in cases where the fluid viscosity is significantly temperature dependent the result is to promote non-uniform fluid flow through the permeable heater body. In some cases the non-uniform flow may promote the occurrence of unwanted localised hot-spots and this leads to premature malfunctioning of the device. The non-uniform temperature distribution problem is particularly serious when heating fluids such as silicone oils the viscosity of which is temperature dependent.

Furthermore, there are practical difficulties in producing a precisely matched set of porous alumina sleeves of correctly graded porosity, which may also be expensive as a result of the matching requirement, and a set suitable for one fluid may not be suitable for another fluid of different density and viscosity.

The present invention is based upon an appreciation, beyond that disclosed in Specification No. 1,182,421 of the importance, in a heating device comprising a combination of two (or more) types of permeable body with significantly different electrical resistivities, that the relationship between the particular characteristics selected for the various permeable bodies is fundamental in removing inherent limitations of a simple porous electrically conducting heater body.

In particular, for a given fluid, device geometry and mode of operation, certain specified parameters of the two (or more) types of permeable body should be critically determined.

The invention provides a device for heating a fluid comprising a fluid permeable, porous, electrical resistance heater body having a fluid entry surface, a fluid permeable, porous flow control member which covers the fluid entry surface of the heater body and which has a fluid entry surface, a fluid supply communicating with the entry surface of the flow control member, the flow control member being oriented such that the static pressure head of the fluid varies over the entry surface of the flow control member, the flow control member being made of a material which has a higher electrical resistance than the heater body, a lower thermal conductivity than the heater body, and a uniform distribution of interconnected pores throughout its entirety, the permeability of the combination of the heater body and the flow control member being such that the impedance of the heater body and the flow control member to flow of fluid causes a pressure drop in the fluid as it passes through the flow control member and the heater body, the total pressure drop in the fluid across the combination of the flow control member and the heater body in the general direction of fluid flow being greater than the variations in static pressure head of the fluid so as to promote a uniform flow of the fluid through the heater body even in the presence of significant differences in static pressure head over the fluid entry surface of the flow control member, the flow control member acting as a thermal impedance varier such that heat generated by the heater body is transferred to the fluid permeating through the device but does not, by thermal or electrical conduction, or thermal radiation, heat the fluid at the entry surface of the flow control member to a temperature high enough to cause boiling in the fluid before it enters the flow control member.

The invention also provides a method of heating a liquid to vaporize it by causing the liquid to flow through a fluid permeable electrical resistance heater body which is heated to a temperature high enough to vaporize the liquid, the method including the step, prior to passing the liquid through the heater body, of causing the liquid to flow through a fluid permeable flow control member in contact with and covering the fluid entry surface of the heater body, the flow control member offering a uniform resistance to the entire flow of the liquid and having a higher electrical resistivity than the heater body and a lower thermal conductivity than the heater body for subjecting fluid passing therethrough to a temperature gradient increasing from a temperature at the entry surface of the flow control member, which is below that at which any liquid vapor bubbles form, up to the temperature generated in the heater body, the flow control member being oriented such that the static pressure head of the fluid varies over the entry surface of the flow control member, the permeability of the combination of the heater body and the flow control member being such that the impedance to fluid flow of the heater body and the flow control member causes a pressure drop in the fluid as it passes through the control member and the heater body, the total pressure drop in the fluid across the combination of the flow control member and the heater body in the general direction of fluid flow being greater than the variations in static pressure head of the fluid at the entry surface of the flow control member.

Preferably the permeability of the flow control member is such that the pressure drop in the fluid across the flow control member alone in the general direction of fluid flow is greater than the variations in the static pressure head of the fluid over the entry surface of the flow control member.

Preferably the specified characteristics of the heater body are such that the fluid pressure drop across the heater body in the general direction of fluid flow is sufficiently small in relation to the pressure drop across the flow control member for the said flow control member characteristics to be the major factor in determining the fluid flow pattern through the permeable components of the device.

Preferably the void structures and geometry of the flow control member and of the heater body and the fit of the flow control member upon the heater body are such as to avoid significant fluid flow and bubble migration under buoyancy forces in directions other than the general direction of fluid flow, especially at the interface between the flow control member and the heater body.

The void structure of the heater body may be of a granular, fibrous, foamed or channelled nature having a high voidage and a high internal surface area for heat transfer.

Preferably the structure of the flow control member comprises interconnected voids uniformly disposed throughout the member.

In one arrangement according to the invention a layer of deformable permeable material is sandwiched between the heater body and the flow control member to avoid or minimise migration under buoyancy forces of vapour bubbles in gaps between the heater body and the flow control member.

Specific constructions of device embodying the invention will now be described by way of example and with reference to the accompanying drawings, in which.

In describing improvements to existing devices it is possible to distinguish between improvements arising from the heater body characteristics, and improvements arising from fluid flow conditions at entry to the heater body surface and from the manner in which the electrically conductive permeable material is engineered in relation to permeable and other components forming parts of the heat transfer and fluid flow system.

A full understanding of the physical effects of the flow control member upon the heating of a fluid in a permeable heater body is somewhat involved and the relative significance of the various parameters ranges widely according to the particular fluid, the structural and other characteristics of the materials from which the device is made, and the particular heating cycle to be carried out. An explanation of these effects and parameters will therefore be developed along with the following description of specific examples of heater device and modes of use of such devices.

Figure 1:
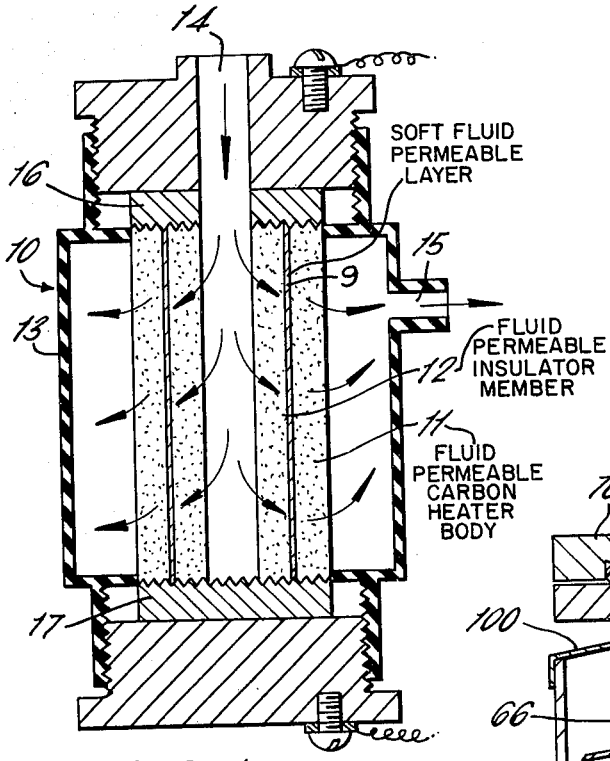
FIG. 1 is a diagrammatic cross-section of a device.

FIG. 1 illustrates diagrammatically the principal components of a device 10 comprising a heater body 11 of permeable carbon in the form of a hollow cylinder. A close fitting hollow cylindrical sleeve 12, of permeable electrically insulating or of high electrical resistivity material, covers the inner surface of the heater body 11.

The heater body 11 together with the sleeve 12 are mounted in a vessel 13 having fluid inlet and fluid outlet conduits 14, 15 and arranged to constrain the fluid to flow through the sleeve 12 and the heater body 11 before emerging from the fluid outlet conduit 15. The sleeve 12 acts as a flow control member which controls the flow of fluid into the heater body 11, and also as a thermal impedance member which restricts heat transfer to the fluid outside the sleeve 12.

Electrical end connectors 16, 17 are mounted at each end of the heater body 11 for passing electrical heating current through the porous carbon of the body 11.

It is important to provide sealing means (not shown) for preventing the input fluid from flowing between the ends of the heater body 11 and sleeve 12 and the electrical connections 16, 17.

For the most satisfactory operation of the device, the objective is to secure a uniform generation of heat throughout the heater body 11 and a uniform flow distribution of the fluid through the heater body 11. It is also necessary that the heat generation and flow are appropriately matched to achieve the desired rise in fluid temperature uniformly within the heater body 11. If the fluid flow into the heater element 11 is uniform over the whole of the entry surface, and the heat generation is uniform axially and circumferentially over a particular plane surface within the permeable heater body 11, then fluid leaving the body 11 exit surface will generally be at a substantially uniform temperature over the whole of this surface. Thus the fluid may be heated to a temperature very close to the saturation temperature without fluid evaporation occurring at any point in the heater body 11 or at the entry surface. To meet this objective the structure of the heater 11 desirably is arranged such that voidage and heat transfer surface area is uniform over a particular plane surface within the body 11 and that the fluid pressure drop is uniform through this surface. It is also desirable for the electrical resistivity of the body 11 to be uniform over the plane surface.

The uniformity of heat generation is influenced by the internal geometry of the heater body 11, the electrical and thermal conductivities of the heater body material, and the dependence of these parameters on temperature. Further, the uniformity of heat generation may be influenced by the thermal and electrical conductivities of the fluid.

The uniformity of fluid flow distribution is influenced by the internal geometry of the heater body 11 and the sleeve 12, manometric or static pressure head variations in the fluid at the input surface of the heater device, and may be influenced by any non-uniformities in heat generation and local variations in fluid viscosity as a result of temperature differences of the fluid.

In practice non-uniformities in both heat generation and flow distribution will exist. For example, a permeable heater body made from granulated carbon will have a range of pore sizes non-uniformly distributed. The consequent non-uniformity in flow distribution will be apparent, but the structure will also provide a matrix of electrical current paths of locally varying resistances so that not only is fluid flow non-uniform but heat generation is also non-uniform. The flow non-uniformity and non-uniformity of heat generation are seldom mutually compensating in their effects.

There is furthermore the significant influence of manometric pressure head on flow distribution to contend with. A cylindrical heater body 15 cm long with the axis placed vertically will have a manometric or static pressure head variation of 15 cm of fluid from one end of the body to the other. If the fluid pressure drop across the body is of the same order there will, in the absence of a flow control member, be an appreciable non-uniformity of fluid flow through the body due solely to the effect of the manometric pressure head difference from top to bottom of the permeable structure. Thus even with a completely uniform heater body void structure it would not be possible to heat the fluid so that it left the body at a uniform temperature over the whole of the exit surface. The effect of such a flow variation through the element structure would not only be to impose a fluid temperature variation but may also, in the case of heating a liquid, impose an upper limit on the bulk fluid temperature after fluid mixing takes place. A 10% flow variation would, in the case of water being heated at atmospheric pressure from 15°C, result in the maximum attainable bulk fluid mixing temperature being about 92° C. Owing to the manometric or static pressure head differences affecting fluid flow, it would be impossible to exceed this bulk temperature level without boiling occurring in the regions of the heater body where the fluid flow was least.

Techniques for improving the uniformity of flow and heat generation in these respects and against other disturbing influences are discussed further below. However, non-uniformities cannot be eliminated completely.

Flow maldistribution produced by static pressure head variation, assuming no flow control member 12, might be overcome by so constructing the heater body 11 that there is sufficient pressure drop within the heater body 11 to poduce uniform flow even where there is significant static pressure head variation over the entry surface of the heater body 11. For example, with a heater body 15 cm long being used to heat water, a pressure drop of about 2–3 p.s.i. has been found to be sufficient to substantially overcome non-uniformity of flow induced by the manometric or static pressure head variation. A high fluid pressure drop across the heater body 11 may be produced by appropriate choice of heater body permeability, pore size and heater body thickness.

However, in practice it is not possible to have an unrestricted choice of geometry for the heater body 11. The geometry cannot be selected purely from the aspect of pressure drop without regard to, fo example, electrical power supply considerations.

In particular, with materials of low resistivity it may be impracticable to utilise a heater body of the desired flow characteristics for example because of such restrictions imposed by the electrical power supply considerations. Consequently it is desirable to adopt a solution which will not only overcome the effects of static pressure head variations but also is such that it does not affect the electrical characteristics of the heater body 11. If the electrical resistivity of the heater body is low, then current supply in general can only be kept within practically acceptable limits if a thin-walled heater body is used. Permeable carbon and permeable sintered metals are virtually the only suitable single phase permeable materials which are available commercially. These are high power density, low electrical resistivity materials (about $5 \times 10^{-2}$ to $10^{-6}$ ohm cm). The electrical rsistivity of permeable sintered metals is so low that such material could only be used for relatively high power outputs involving special design of the heater body. The discussion herein is limited therefore to heater bodies of permeable carbon, although the principles will apply, of course, to any permeable heater materials which may be developed with similar electrical and permeability properties.

The geometry of the permeable heater body 11 is influenced strongly by the material resistivity since for a given heater length L to area A ratio and level of heat generation (power W), electrical resistivity $\rho$ determines the electrical current (I) supply required. The relevant relationship is $$W = I^2 \rho \left(\frac{L}{A}\right).$$

As stated above, when the electrical resistivity of the heater body 11 is low, in general it is only possible to keep current supply within reasonable limits by employing a thin-walled heater body. For example, a granular carbon heater body of resistivity 0.05 ohm cm, having 35% voidage, an average pore diameter of 110 microns and rated at about 5 kilowatts, would have a wall thickness of less than 0.5 cm if the outside diameter of the cylinder is about 3.5 cm and the length about 10 cm. Such a heater body can only be expected to produce a pressure drop across the wall of a few centimetres of water pressure at the flow rates which would typically be used when heating a liquid and this is less than the static pressure head differences which would exist. The consequential effects of static pressure head variation on flow cannot be overcome simply by choosing a heater body 11 with suitable pressure drop characteristics since the electrical supply considerations may rule this out.

As proposed in Specification No. 1,182,421 the alumina layer can limit the input surface temperature to avoid onset of surface boiling, but, without the further important appreciation of pressure drop considerations, it will be fortuitous whether the device operates satisfactorily with a barrier layer designed simply on thermal impedance considerations, because a total pressure drop of a few centimetres of water across the wall of the heater body necessarily implies instability in the presence of a 10 cm variation in static pressure head, unless there is sufficient pressure drop in the barrier layer to provide uniform flow into the heater body under such conditions of static pressure head variation.

Now, referring to FIG. 1 hereof, since there is no generation of heat within the sleeve 12, there is less constraint upon its design as compared with the heater body 11. Thus, for example, the thickness and pore dimensions can be arranged to produce a high pressure drop across the wall thickness of the sleeve 12. If, in fact, this pressure drop (across the sleeve 12) is arrangned to exceed pressure variations due to structural non-uniformity and static pressure head variations, the effect can be to allow the device to be used to heat a liquid close to its saturation temperature and avoid the limitation on bulk fluid temperature after mixing, which the flow non-uniformity arising from static pressure head variation would otherwise produce. Thus if the pressure drop across the sleeve 12 is sufficiently large, the effect of manometric pressure head on flow becomes insignificant.

In fact, given appropriate thermal impedance in the flow control member 12 and sufficient pressure drop across it for stabilising flow into any region where vapour is formed, then the flow control member 12 enables such vapour generation to be tolerated. Mixing in the fluid emerging from the output surface of the heater body balances wide local variations in temperature very quickly.

These considerations lead naturally to an appreciation of the value of a flow control member, designed to give an appropriate pressure drop and thermal impedance, where a liquid is to be evaporated. Assuming, for the reasons explained above, a thin-walled heater body, if the latent heat of the liquid is high and/or if a certain level of superheating of the vapour in the heater is desired, evaporation may be occurring close to the liquid entry surface of the heater. For example, water being evaporated to dryness from an initial temperature of 15° C at an atmospheric pressure would, in passing through a permeable heater body 11 of wall thickness 0.5 cm generating heat uniformly, reach a temperature of 100° C within a distance of less than 0.1 cm from the entry surface. The function of the flow control member 12 is then indispensable for providing both thermal impedance to keep the entry surface temperature below the liquid boiling point and sufficient pressure drop in the liquid phase to stabilise flow into the regions where vapour is forming. Otherwise, surface boiling can set in with the consequent complete disruption of flow and breakdown in satisfactory operation of the heater.

It is important to note that, due to back radiation of heat and to back conduction of heat through both the material of the flow control member 12 and the fluid itself, evaporation may occur within the flow control member. This can be tolerated, as explained, provided the pressure drop in the liquid phase (in this case wholly within the flow control member) is sufficient to stabilise flow into the region where vapour is formed.

Vaporisation is a random process and likely to cause local pressure perturbations which affect flow uniformity and may lead to vapour bubbles back-streaming to cause vapour locks if these bubbles are generated close to the entry surface of the heater body 11 and at a point where only a fraction of the total pressure drop across the heater body 11 has been developed. If there are significant flow or heat generation non-uniformities this phenomenon may be enhanced, such that a continuous stream of vapour bubbles emerges from certain regions of the heater body 11 entry surface. Hence, there is also the problem of minimising the effect on fluid flow of local pressure peturbations during vaporisation and prevention of vapour bubble backstreaming. To overcome this latter problem it is required that the pore size of the sleeve 12 should preferably be smaller than the pore size of the heater body 11 and that any gaps between the flow control member 12 and the heater body 11 must be small enough to avoid significant vapour bubble migration along them due to buoyancy forces. To this end, a layer 9 of soft permeable material, such as Fiberfrax filter paper, may advantageously be inserted between the flow control member 12 and the heater body 11. This prevents or limits bubble migration along channels formed by asperities of the two contiguous permeable materials. Alternatively, the flow control member 12 itself may comprise a tube of filter paper or permeable fibrous material which moulds itself to the carbon heater body 11. A further alternative is to form the flow control member 12 by plasma spraying a thick layer of permeable material, such as alumina, onto the carbon heater body 11. However, with such a structure there is risk of cracking under the stresses of differential thermal expansion of the heater body and flow control member and the absence of discontinuity at the interface reduces the thermal impedance. The existence of the smaller pores in the sleeve 12 tends to break up any back-streaming bubbles such that they are more readily condensed within the sleeve 12 in the entering colder liquid. It may sometimes be advantageous to provide for the pressure drop in the sleeve 12 to be significantly greater than would be required purely from considerations of static pressure head vairations and their effect on fluid flow uniformity.

In the consideration above of origins of non-uniformity in liquid flow through the permeable heater body 11, it was assumed that the liquid viscosity did not vary significantly with temperature. Many liquids exhibit a significant variation in viscosity with temperature, such as silicone oils, which are to be heated by a permeable heater device incorporated in a vapour vacuum pump illustrated in FIG. 2 and described more fully below.

As explained, structural non-uniformities and manometric pressure variations cause non-uniformities in both heat generation and fluid flow. Where these non-uniformities in heat generation and fluid flow are not self-compensating, there is mis-match. Mis-matching implies variations in temperature from one region to another in planes of the heater body where there should be a constant temperature. If such temperature variations produce viscosity variations, then the non-uniformity of flow is further aggravated, since fluid flow rate is dependent upon viscosity.

Here again, the flow control member, providing an adequate pressure drop, serves to stabilise flow in defining the flow pattern in a region where there is not much temperature variation perependicular to the flow. This flow pattern, supported by the relatively high pressure drop across the flow control member, is imposed upon the heater body, and can be largely maintained within thin walled heater elements, even in cases where the permeable carbon structure has relatively high voidage.

Further constraints are imposed upon the operating conditions if the fluid is heat sensitive, e.g., degrading or cracking if raised above a predetermined temperature. Two possibilities arise in that one may wish to avoid degradation or cracking, as for example in evaporating a silicone oil in a vacuum vapour pump, or the purpose of the heating step may be to achieve cracking, but it may be important that this occurs throughout the fluid at a substantially constant distance along the flow direction from the heater input surface.

Mis-match in flow and heat generation patterns leading to "hot-spots" clearly has to be avoided with such heat sensitive fluids. A flow control member in accordance with the present invention influences flow non-uniformity in two respects important to this consideration. Firstly, in providing a relatively high pressure drop, the influence upon flow in the heater body of manometric pressure variations is reduced. Secondly fluid flow into a region where overheating or vaporisation is occurring can be stabilised so that stable operation is possible.

Thus, the flow control member contributes to solving problems in heating heat sensitive fluids in a permeable heater device, but its main contribution is in enabling high power density, low electrical resistivity permeable materials to be used for heating and evaporating fluids and, if desired, superheating the vapour. A remarkable feature of the flow control member is that a permeable heater device can continue to operate satisfactorily (with fluids that are not heat sensitive) despite severe hot spot development in the heater body.

Therefore, in the general case of a device which may be used for heating a fluid close to but below the saturation temperature, for heating a fluid to the saturation temperature so as to produce a wet or dry saturated vapour, and for heating a fluid such that it is evaporated and superheated to a high temperature, the combination of heater body 11 and sleeve 12 is such that the sleeve 12 has four main functions. Firstly it acts as a flow distributor such that fluid static pressure head differences are minimised. Secondly it acts as a barrier to back-streaming vapour bubbles such that they are condensed within the sleeve or forced to migrate in the forward direction of fluid flow. Thirdly it prevents pressure perturbations arising during the vaporisation process from having any significant influence on fluid flow uniformity and stability. Fourthly it acts as a thermal impedance such that evaporation of the fluid can only take place within either the heater body 11 or within the sleeve 12, or within both heater body 11 and sleeve 12.

The characteristics of the permeable sleeve 12 which are important in determining its thermal impedance and heat transfer function are its thermal conductivity, the voidage and the internal void structure of the sleeve 12. Of these characteristics the voidage and void structure also affect flow and pressure drop so that the flow distribution and thermal impedance functions of the sleeve 12 are interdependent. This requires a critical selection of the parameters of the sleeve 12 and this topic is discussed further below.

So far it has been assumed that the structure of the sleeve is such that it does not of itself create a non-uniform flow into the heater 11. There would be little point in overcoming the static pressure head effects on flow uniformity if the sleeve 12 itself created a non-uniform flow as a result of its structural characteristics. A further reason for postulating a uniform sleeve 12 structure exists in cases where a significant amount of heat is radiated and conducted into the sleeve from the heater 11. It is desirable that this heat is received and transferred uniformly to the fluid within the matrix 12, otherwise non-uniformity in fluid temperature and fluid quality will exist in the fluid entering the heater 11, with consequent effects on fluid conditions at exit from the heater body 11.

The first requirement for the sleeve structure is that the voids shall be substantially uniformly distributed throughout the material and that where a range of void sizes exist these sizes should also be substantially uniformly distributed. If this is the case then pressure drop and fluid flow can be reasonably uniform through the whole of the sleeve. The porosity must also be sufficiently high and the pore size sufficiently small for fluid flow into and out of the sleeve to be virtually a continuous sheet and not jet-like. It has been found that porosities of about 35% are suitable and that pore size should generally be below about 100 microns with a preferred range below 30 microns where a high pressure drop is required.

If the parameters of the sleeve 12 are correctly chosen it is possible for a temperature gradient of considerable magnitude to exist through the sleeve 12 and heater 11 without the occurrence of boiling of the fluid on the entry surface of the sleeve 12.

Various types of material may be used for the sleeve 12 provided its electrical resistivity is sufficiently high for the heat generation within the sleeve to be small enough to avoid the surface evaporation problems which have previously been discussed. For example a permeable sleeve of granular alumina or mullite has been found to be satisfactory provided the pore size and distribution is sufficiently uniform. Cases have however been encountered where the method of manufacture of the porous material has been such as to produce markedly non-uniform porosity and this has led to the generation of hot spots in the heater 11 as a result of flow non-uniformity at entry to the heater 11. Alternatively permeable tubes formed from wrapped ceramic paper may be used, such as Fiberfrax. Permeable tubes consisting of ceramic fibres with a high voidage have been found to be particularly effective when a very high thermal impedance is desirable, since the structure has a low thermal conductivity.

It has been postulated above that it is desirable for the heater body 11 to have a low pressure drop in relation to the sleeve 12. This means that in general the fluid flow pattern at entry into the heater 11 will tend to persist while the fluid is within the heater body 11, even if the structure is such as to produce some degree of pressure drop non-uniformity. A contributory factor to this condition is the relatively short fluid residence time (milliseconds) which obtains in some cases. Consequently the structural uniformity of heater 11 is not generally of prime importance as far as flow uniformity is concerned when the sleeve 12 determines the flow pattern.

Structure of the heater body 11 is however of major significance from the aspect of heat generation and heat transfer. From the heat generation point of view the requirement is for there to be a minimum of macroscopic variation of material cross-section since this causes the resistivity and heat generation to vary from region to region. Some variation must and obviously can be tolerated provided the variation occurs ovr small distances and there is a large number of such variations uniformly distributed.

Certain types of structure are better than others from the heat generation point of view. A heater body of substantially granular particles of an irregular spherical nature, consists of an assembly of comparatively low resistance particles bonded or fused at low area contact points which are essentially comparatively high resistance regions. This type of structure is predisposed towards hot spot formation since most of the heat is generated at these contact points and must be transferred to other regions of the grains before transfer to the fluid can take place. Consequently local temperature gradients are encouraged and if there is even a slight degree of local flow non-uniformity due to porosity or pore size differences, or other factors, hot spots will develop. Where the material has a negative temperature coefficient of resistivity the condition is worsened and it is more critical when the porosity and pore size are low. If a granular structure is to be used then special precautions must be taken during manufacture of the heater body 11 to ensure adequate uniformity of voidage and pore size.

A fibrous structure has been found to be particularly advantageous for the heater body 11 from the heat generation and transfer aspect. It is preferable for the fibres to be of small diameter and to be firmly bonded to adjacent fibres at the points of contact. A high voidage is advantageous and the fibrous structure permits a much higher voidage to be attained with a lesser degree of structural weakness than would exist in a granular element. Foamed structures are also attractive in having high voidage and internal surface area but the cell structure is not as suitable as the fibrous matrix if the fluid can suffer thermal degradation, since there is more prospect of fluid entrapment within the cells of the foamed material.

Techniques for manufacture of a fibrous carbon heater body 11 include the carbonisation of natural or artificial fibres which have been woven or otherwise agglomerated into a matrix of suitable permeability and pore size.

The design of electrical end connections is also important for improving uniformity of heat generation. If the current does not enter the element uniformly a predisposition towards non-uniform power generation is set up.

One form of suitable end connection consists of a series of small protrusions which penetrate into a permeable matrix, thus ensuring that the end connection pressure is not confined to one region because of imperfections in the end surfaces. The protrusion may be produced by forming regular concentric grooves or a type of knurled geometry providing no significant end leakage of fluid occurs.

End pressure on the electrical contact surfaces must be maintained if the fluid flow is from the inside to the outside of a cylindrical heater body. This can be provided by a rod passing down the centre of the heater body and if this is permeable, it may also be used as a primary flow distributor.

An alternative means of providing fluid sealing and electrical contacts is to use a washer of soft electrically conducting material interposed between end flanges and heater body. The soft material may be graphite and of higher resistivity than the heater body such that the gasket acts as a guard ring and promotes a more uniform axial temperature distribution, since heat losses into the end connections may be reduced.

It will be appreciated that the parameters, for example permeability, electrical and thermal conductivity, pore size and dimensions of the heater body 11 and the flow control member 12 need to be chosen according to the fluid to be heated and the heating cycle, and within the limits imposed by available materials which are suitable for the purpose. The value of the parameters chosen can vary appreciably since the designer has some freedom of choice.

Actual parameters can thus vary widely, even for one particular fluid and heating sequence, since the designer may choose to compensate for high permeability in the flow control member by making it of greater wall thickness. However, it accordance with the present invention the design has to be carried out in accordance with the constraining principles of pressure drop and thermal impedance discussed above.

In particular, if $\Delta P_B$ is the fluid pressure drop across the flow control member 12, $\Delta P_E$ is the pressure drop across the permeable heater body 11, and $\Delta P_H$ is the manometric or static fluid pressure variation over the fluid entry surface to the sleeve 12, then it is required that

1. $\Delta P_B > \Delta P_E$ and preferably $\Delta P_B >> \Delta P_E$

2. $\Delta P_B > \Delta P_H$ and preferably $\Delta P_B >> \Delta P_H$

Referring to FIG. 1, a specific example of a set of parameters for a heater suitable for heating water, for heating water to produce wet steam and for heating water to produce dry or superheated steam will now be discussed.

The heater body 11 comprises Schumacher grade 40 permeable carbon in hollow cylindrical form of dimensions 3.50 cm outside diameter, 2.65 cm internal diameter and 10.00 cm length. The average pore diameter of the body 11 is 110 microns, with a maximum pore diameter at 180 microns. The porosity (porespace/-volume) is 35% to 40%. The measured resistivity is 0.052 ohm cm and the density of the carbon (not of the heater body as such) is in the range 1.25 to 1.50 $gm/cm^3$.

The flow control member 12 comprises a hollow cylinder of Celloton V3 which is a recrystallised alumina/silica mullitic structure of dimensions 2.45 cm outside diameter, 1.90 cm internal diameter and 10 cm length. The average pore diameter is 3 microns, and comparatively small scatter, porosity about 40% and permeability $2 \cdot 19 \cdot 10^{10}$ cm$^2$.

For reasons explained above, a layer of Fiberfrax ceramic fibre filter material is sandwiched between the heater body 11 and the flow control member 12. In this example, Fiberfrax 970FH without binder is employed, this material having a compostion as follows:

| | | |
|---|---|---|
| $Al_2O_3$ | 50.9% | by weight |
| $SiO_2$ | 46.8% | " |
| $B_2O_3$ | 1.2% | " |
| $Na_2O$ | 0.8% | " |
| Trace inorganics | 0.3–0.5% | " |

Thermal conductivity ranges from 0.4 Btu inch/hour.ft$^2$ ° F at 400° F to 1.3 Btu inch/hour.ft$^2$ ° F at 1700° F ($5.8 \times 10^{-4}$ Joules cms/sec. cm$^2$ ° C at approximately 200° C to $18 \times 10^{-4}$ Joules cms/sec. cm$^2$ ° C at approximately 927° C).

The ends of the heater body 11 and flow control member 12 are sealed with Sigriflex 0.5 mm thick which has negligible permeability, a thermal conductivity of 3 kilocalories/metre. hour ° C, and a measured electrical resistivity of approximately 0.1 ohm cm.

The heater device (i.e. body 11 and sleeve 12) has an electrical resistance of 0.145 ohms at 20° C and 0.100 ohms at 100° C and is rated at 4 kilowatts at 20 volts. The operating current is approximately 200 amps which represents a current density at the ends of approximately 49 amps/cm$^2$.

For liquid flow through both flow control member 12 and heater body 11 the pressure drop across the heater body 11 is negligible. However, where the fluid passing through the heater body contains a significant proportion of steam, the much larger specific volume and different flow properties of the steam result in a significant pressure drop across the heater body. Calculations indicate that, in this example, the pressure drop across the flow control member is approximately 2.5 lbs/in$^2$ (the pressure drop, assuming dry steam, across the heater body may be approximately 0.5 lbs/in$^2$). The prime operating requirement that the pressure drop across the flow control member should exceed the manometric pressure variation and the pressure drop across the heated body is thus met in this example for heating, evaporating and superheating water.

Figure 2:
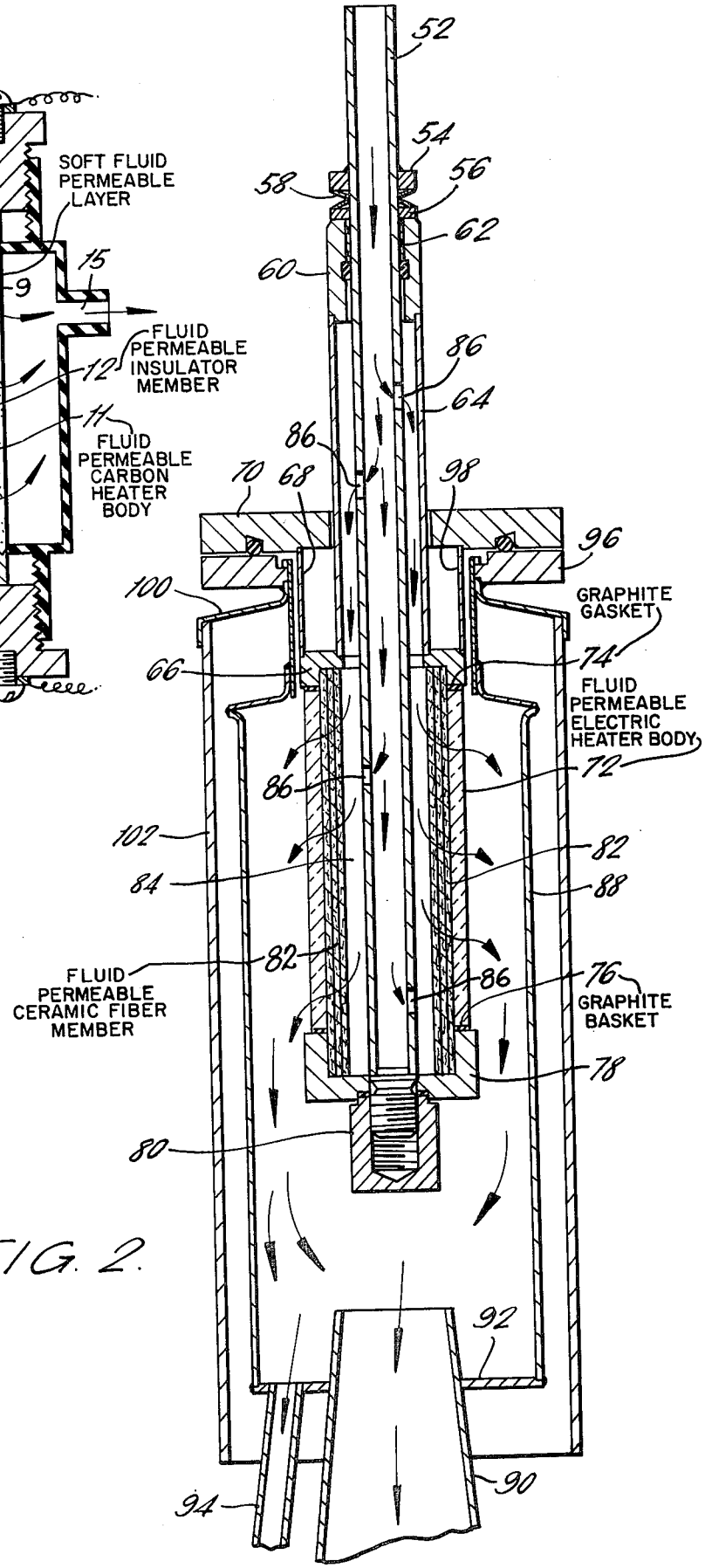
FIG. 2 is a diagrammatic cross-section of another device incorporated in a vaporiser intended for use in a vapour vacuum pump.

FIG. 2 is a sectional view of a vaporiser for use in a vapour-driven vacuum pump.

The vaporiser includes a central support tube 52, which is secured at its upper end, in a fluid-tight manner, to a mounting member (not shown) and to means for passing the liquid to be vaporised to the interior of the tube. Welded or otherwise secured to the tube is a collar 54 adjacent to a slidable collar 56, the two collars having positioned between them two or more appropriately-directed Schnorr or Belleville washers 58.

Movable with collar 56 is a sleeve 60, the collar 56 and sleeve 60 being sealed against the loss of liquid from the interior of the vaporiser, and being electrically insulated from the tube 52, by means of a layer 62 of plastics material.

Extending from sleeve 60 is a thin-walled tube 64 having its lower end fixed to an annular end cap 66 attached to a short, thin-walled tube 68 of stainless steel. Tube 68 is connected at its upper end to a support flange 70. One end of an electric cable (not shown) for the heating current is clamped directly to the tube 64.

The cap 66 is in electroconductive contact with the upper end (as viewed) of a hollow cylindrical permeable heater body 72 through an annular gasket 74 of flexible graphite. A particularly suitable form of graphite is that sold under the trade name "Grafoil" by Union Carbide Corporation.

A similar gasket 76 is positioned between the lower end of the heater body 72 and a second end cap 78 which is secured to the lower end of tube 52, by a nut 80, in a manner which does not form part of the subject-matter of the present invention and which is therefore not described in further detail.

Positioned in intimate contact with the inner surface of the heater body 72 is a flow control member 82 comprising three layers of a permeable ceramic fibre material in paper form, specifically that sold under the registered trade mark "Fiberfrax" by the Carborundum Company Ltd. It is important for the material to be in intimate contact with the inner surface of the heater body 72. To this end, a light helical spring (not shown) is positioned within chamber 84 so as to press the fibrous material outwardly into contact with the heater body 72.

In alternative designs the Fiberfrax may be replaced by, or used in conjunction with, a cylindrical sleeve of permeable ceramic of granular, foamed of fibrous form to give the pressure drop flow dispersing and thermal impedance characteristics desired.

it will be seen that the sleeve 60, tube 64, and cap 66, permeable material 82 and end cap 78 define the chamber 84. The liquid to be vaporised enters this chamber through passages 86 formed in the walls of tube 52.

Surrounding the heater body 72, and spaced from it, is a casing 88 leading to a nozzle 90 arranged to direct the emitted vapour into the interior of a vapour vacuum pump, of which the other components are conventional and are therefore not shown in the drawing. A feature to note is that the inner end of nozzle 90 extends above the end wall 92 of casing 88. This is to ensure that any unvaporised liquid which passes through the heater body 72, and any condensate produced in the interior of casing 88, flow through a drip tube 94 in preference to passing down the nozzle 90. The drip tube 94 preferably extends to the exterior of the pump housing, or to adjacent the exterior water-cooled surfaces thereof, so that the liquid from the tube does not interfere with operation of the pump.

The casing 88 is supported from a flange 96 which is secured to flange 70 in a fluid-tight manner. The connection is through a thin-walled tube 98 of stainless steel which is spaced radially by only a short distance from tube 68.

Also secured to flange 96, by means of an intermediate tapered support 100, is a radiation shield 102. This is provided primarily to keep the enclosed boiler unit hot and to reduce recondensation of vapour inside the boiler unit, and only secondarily to prevent radiation from the heated parts of the vaporiser from falling directly on the inner surfaces of the vacuum pump. This is important because, under operating conditions, the evacuated interior of the pump favours the transference of heat by radiation rather than by either conduction of convection, so that the shield 102 acts to maintain the temperature differential between the vaporiser and the pump housing.

The dimensions of the heater body 72 are 3.7 cm outside diameter, 2.4 cm internal diameter, 8 cm length. The body has a specific gravity of 0.25 and an electrical resistivity of 0.026 ohm cm at 250° C.

The flow control member 82 dimensions are 2.4 cm outside diameter, 1.8 cm internal diameter, 9 cm length. The material (Fiberfrax) from which the flow control member 82 is made has a density of 20 sq ft/lb.

In operation the input power is 2.2 kilowatts and silicone oil is used at a flow rate of 225 cc/min. The pressure drop has not been measured under operation conditions, but at room temperature the pressure drop across the flow control member 12 at the above-mentioned flow rate was 150 torr, from which it may be estimated that, under operating conditions, the pressure drop across the flow control member is about 40 torr and the pressure drop across the heater body 72 will be significantly less than this.

The supply of silicone oil to the heater device is passed through a filter upstream of the heater device. It will be apparent that the filter should have a smaller pore size than the flow control member. However, the filter should not be a flow controlling restriction, this problem being met b providing an appropriately large external surface area in the filter. In this example a sintered bronze filter is employed with a mean external surface area of 107 sq cm. The filter is such as will filter off particles larger than about 15 to 20 microns.

The invention is not restricted to the details of the foregoing examples. For instance, hollow cylindrical configurations of heater body have been described, as these are generally preferred. However, other geometrical configurations may be employed if desired.

We claim:

1. In a fluid heating arrangement, a device for heating a fluid comprising a fluid permeable, porous, electrical resistance heater body having electrical input and output ends and a fluid entry surface, a fluid permeable, porous flow control member which covers the fluid entry surface of said heater body, said flow control member having a fluid entry surface, a fluid supply communicating with the entry surface of said flow control member, said flow control member being oriented such that the static pressure head of the fluid varies over the entry surface of the flow control member, the flow control member being made of a material which has a higher electrical resistance than the heater body, a lower thermal conductivity than the heater body, and a uniform distribution of interconnected pores throughout its entirety, the permeability of the combination of the heater body and the flow control member being such that the impedance of the heater body and the flow control member to flow of said fluid causes a drop in pressure in the fulid as it passes through the flow control member and the heater body, the total pressure drop in the fluid across the combination of the flow control member and the heater body in the general direction of fluid flow being greater than said variations in static pressure head of the fluid at the entry surface of the flow control member so as to promote a uniform flow of the fluid through the heater body even in the presence of significant differences in static pressure head over the fluid entry surface of the flow control member, said flow control member acting as a thermal impedance barrier such that heat generated by a heater body is transferred to the fluid permeating through the device but does not, by thermal or electrical conduction, or thermal radiation, heat the fluid at the entry surface of the flow control member to a temperature high enough to cause boiling in the fluid before it enters the flow control member.

2. A device according to claim 1 wherein pores of different sizes exist throughout the flow control member, and the different sizes of pores are substantially uniformly distributed throughout the entirety of the flow control member.

3. A device according to claim 1 wherein pores of different sizes exist throughout the flow control member and the heater body and the different sizes of pores are substantially uniformly distributed throughout the entirety of the flow control member and the heater body.

4. A device according to claim 1 wherein 35% to 40% of the volume of the flow control member is constituted by the pores.

5. A device according to claim 4 wherein the pore size of said flow control member is less than 100 microns.

6. A device according to claim 4 wherein the pore size of said flow control member is less than 30 microns.

7. A device according to claim 4 wherein the average pore size of said flow control member is 3 microns.

8. A device according to claim 2 wherein the permeability of the flow control member is such that the pressure drop in the fluid across the flow control member alone in the general direction of fluid flow is greater than the variations in the static pressure head of the fluid over the entry surface of the control member.

9. A device according to claim 1 wherein the permeability of the flow control member is less than the permeability of the heater body so that the pressure drop in the fluid across the flow control member in the general direction of flow is greater than the pressure drop in the fluid across the heater body in the general direction of flow.

10. A device as claimed in claim 1 wherein the distribution of pores and pore sizes throughout the flow control member and the heater body, and the fit of the flow control member upon the heater body are such as to avoid significant migration under buoyancy forces of vapor bubbles.

11. A device as claimed in claim 1 wherein a layer of deformable fluid permeable material is sandwiched between the heater body and the flow control member to reduce migration under buoyancy forces of vapor bubbles in gaps between the heater body and the flow control member.

12. A device as claimed in claim 1 wherein electrical connections to the material of the heater body are made via electrically conductive material adapted to bed into the electrical input and output ends of the heater body.

13. A device as claimed in claim 1 wherein there is provided a layer of material adjacent each of the electrical input and output ends, which material has a resistivity higher than that of the heater body.

14. A device as claimed in claim 1 wherein means are provided for constraining fluid to flow into the flow control member and includes sealing means for preventing the fluid from entering the heater body endwise between the heater body and the flow control member.

15. A device as claimed in claim 1 wherein the heater body comprises permeable carbon.

16. A device as claimed in claim 1 wherein the flow control member comprises a fluid permeable layer of ceramic fibrous material.

17. A device as claimed in claim 1 wherein the flow control member has pores which are smaller than pores formed in the heater body.

18. A device according to claim 1 wherein the flow control member is electrically non-conducting.

19. A device according to claim 1 wherein the flow control member is made of a material comprising alumina.

20. A device according to claim 1 wherein the flow control member is made of a material comprising alumina and silica.

21. A method of heating a liquid to vaporize it by causing the liquid to flow through a fluid permeable electrical resistance heater body which is heated to a temperature high enough to vaporize the liquid by electrical current therethrough, the method including the step, prior to passing the liquid through the heater body, of causing the liquid to flow through a fluid permeable flow control member in contact with and covering the fluid entry surface of the heater body, the flow control member offering a uniform resistance to the entire flow of the liquid and having a higher electrical resistivity than the heater body and a lower thermal conductivity than the heater body for subjecting fluid passing therethrough to a temperature gradient increasing from a temperature, at the entry surface of the flow control member, which is below that at which any liquid vapor bubbles form, up to the temperature generated in the heater body, the flow control member being oriented such that the static pressure head of the fluid varies over the entry surface of the flow control member, the permeability of the combination of the heater body and the flow control member being such that the impedance to fluid flow of the heater body and the flow control member causes a drop in pressure in the fluid as it passes through the control member and the heater body, the total pressure drop in the fluid across the combination of the flow control member and the heater body in the general direction of fluid flow being greater than said variations in the static pressure head of the fluid at the entry surface of the flow control member.

22. A method as claimed in claim 21 wherein the permeability of the flow control member is such that the pressure drop in the fluid across the flow control member alone in the general direction of fluid flow is greater than the variations in the static pressure head of the fluid over the entry surface of the flow control member.

* * * * *